US007128257B2

(12) United States Patent
Hyatt et al.

(10) Patent No.: US 7,128,257 B2
(45) Date of Patent: Oct. 31, 2006

(54) OCTAGONAL BULK BIN WITH MEANS TO RESIST INITIATION OF FAILURE OF THE VERTICAL SCORE IN THE BIN

(75) Inventors: Kenneth C. Hyatt, Springdale, AR (US); Michael A. Zimmerman, Hattieville, AR (US)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 10/316,966

(22) Filed: Dec. 11, 2002

(65) Prior Publication Data

US 2003/0116615 A1 Jun. 26, 2003

Related U.S. Application Data

(60) Provisional application No. 60/339,175, filed on Dec. 11, 2001.

(51) Int. Cl.
*B65D 5/00* (2006.01)

(52) U.S. Cl. ..... 229/183; 229/920; 229/931; 229/132

(58) Field of Classification Search ..... 229/934, 229/920, 183, 930, 931, 132
See application file for complete search history.

(56) References Cited

U.S. PATENT DOCUMENTS 1,580,147 A * 4/1926 McClean ..... 229/104
1,667,376 A * 4/1928 William ..... 206/45.25
1,921,150 A * 8/1933 Bomberger ..... 229/132
2,141,752 A * 12/1938 Hoarle ..... 229/154
2,858,969 A * 11/1958 Williams ..... 229/117.17
3,094,265 A * 6/1963 Hovland ..... 229/133
3,106,330 A * 10/1963 Ruben ..... 229/132
3,261,536 A * 7/1966 Bixler ..... 229/133
3,481,527 A * 12/1969 Jacke ..... 229/125.34
4,022,372 A * 5/1977 Graser ..... 206/193
4,688,716 A * 8/1987 Winterling ..... 229/137
D309,107 S * 7/1990 Winterling ..... D9/433
5,042,684 A * 8/1991 West et al. ..... 206/386
5,772,108 A * 6/1998 Ruggiere, Sr. et al. ..... 229/109
5,848,748 A * 12/1998 Bouraoui et al. ..... 229/125.42
5,868,367 A * 2/1999 Smith ..... 248/174
6,024,279 A * 2/2000 McGary et al. ..... 229/199
6,588,651 B1 * 7/2003 Quaintance ..... 229/109

* cited by examiner

*Primary Examiner*—Tri M. Mai
(74) *Attorney, Agent, or Firm*—Thomas W. Barnes, III; Daniel C. Stelter; Dennis H. Lambert

(57) ABSTRACT

In a bulk bin having side walls joined to one another at adjacent edges along vertical scores, and bottom flaps joined to bottom edges of the side walls along a flap score, with adjacent flaps separated from one another by a flap slot, a shaped cut is made at the terminal end of the flap slot to redirect stress away from the bottom end of the vertical score and resist initiation of tearing of the vertical score at that point. In one embodiment, the shaped cut is a downwardly open hook shape which terminates in an end pointing laterally away from the vertical score and into the flap. In another embodiment, the shaped cut resembles a modified Greek letter psi (ψ), with the ends pointing laterally away from the vertical score, and in still another embodiment, the shaped cut is "T" shaped, with the ends of the "T" pointing laterally away from the vertical score.

10 Claims, 6 Drawing Sheets

OCTAGONAL BULK BIN WITH MEANS TO RESIST INITIATION OF FAILURE OF THE VERTICAL SCORE IN THE BIN

This application claims the benefit of U.S. Provisional Patent Application Ser. No. 60/339,175, filed Dec. 11, 2001.

BACKGROUND OF THE INVENTION

1. Field of the Invention

This invention relates generally to bulk bins, and more particularly to bulk bins made of corrugated paperboard with means to resist initiation of tearing of the vertical scores in the bin.

2. Prior Art

Many products are stored and shipped in bulk containers, which are commonly constructed of corrugated paperboard. These containers or bins may be used to hold up to 2400 pounds of product, and are often used to ship and store flowable products. For instance, the poultry industry uses corrugated paperboard bulk bins to ship and store flowable de-boned meat product. Flowable products, in particular, exert an enormous force on the side walls of the bin, tending to cause them to bulge outwardly, especially toward the bottom of the bin.

Bulk containers or bins made of corrugated paperboard have side walls joined along vertical score lines, and bottom flaps are usually joined to the bottom edges of the side walls, with the flaps separated from one another by flap cuts or slots. In conventional constructions the flap slots terminate at or closely adjacent the lower end of the vertical scores, and the stresses exerted on the bin when it is filled with flowable product tend to concentrate in the area where slots terminate adjacent the bottom end of the scores. This stress concentration further tends to focus along an axis leading from the flap slot into the lower end of the vertical score, with the result that splitting of the vertical score is initiated, sometimes resulting in tearing along the entire length of the vertical score and failure of the bin.

Accordingly, there is need for a bulk bin having means to prevent initiation of splitting of the vertical score in a bulk bin, caused by concentration and focusing of stresses into a lower end of the vertical score from the flap slot.

SUMMARY OF THE INVENTION

The invention provides a means for resisting this initiation of a tear along the vertical score line by separating the end of the flap slot from the end of the vertical score line, and modifying the shape of the terminal end of the flap slot to redirect the stress away from the end of the score and thereby eliminate a potential starting point for a split to begin.

More specifically, a shaped cut is made at the end of the flap slot to space the end of the flap slot from the end of the vertical score, with the ends of the cut pointing away from the vertical score.

In one embodiment, the modified slot terminates in a shape much like a modified Greek letter psi (ʊ). This has the effect of moving the termination of the flap slot one inch away from the end of the vertical score line, and placing it in the flap score. This new shape diverts the internal pressure of the contents away from the base of the vertical score.

In a modified version, a "J" shaped cut is placed at the end of the flap slot, with the curved part of the "J" positioned adjacent the base end of the vertical score line and the end of the J shaped cut pointing away from the vertical score and back toward the flap.

Other shaped cuts, such as T-shapes, hook shapes, and the like, can also be utilized so long as they redirect the stresses away from the lower end of the vertical score. Further, the invention can be applied in bulk bin constructions having four, six or eight sides, or any other number of sides, and in bins having single, double or triple wall construction, or other multiple wall thicknesses Reinforcing bands, such as, for example, sesame tape, can also be placed around the bin at spaced intervals along its height, beginning one inch above the flap score, to reinforce the bin and resist bulging and/or failure caused by the pressure of the contents.

BRIEF DESCRIPTION OF THE DRAWINGS

The foregoing as well as other objects and advantages of the invention will become apparent from the following detailed description when considered in conjunction with the accompanying drawings, wherein like reference characters designate like parts throughout the several views, and wherein.

DETAILED DESCRIPTION OF THE PREFERRED EMBODIMENTS

Figure 1:
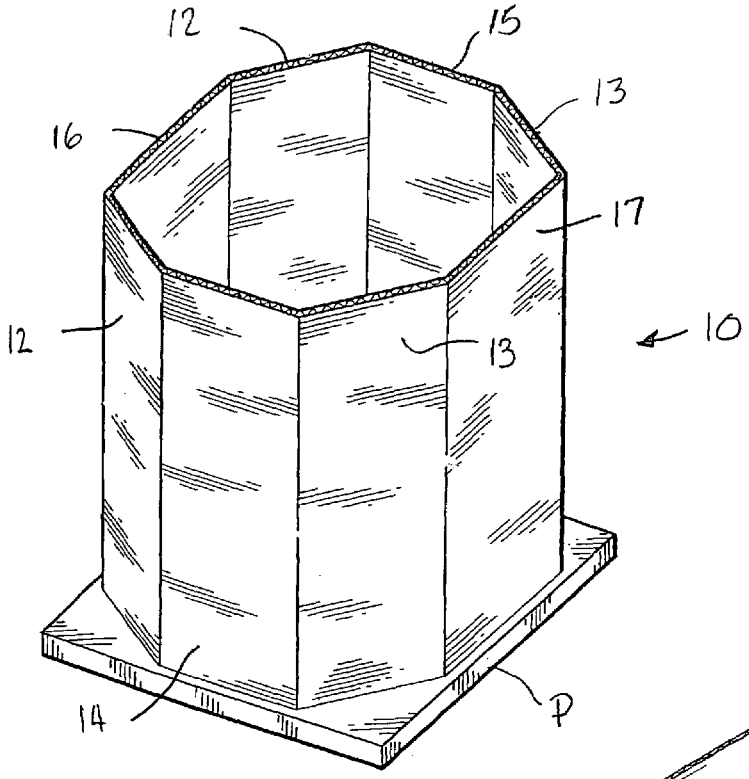
FIG. 1 is a top perspective view of a typical octagonal bulk bin in which the invention may be used.
Figure 2:
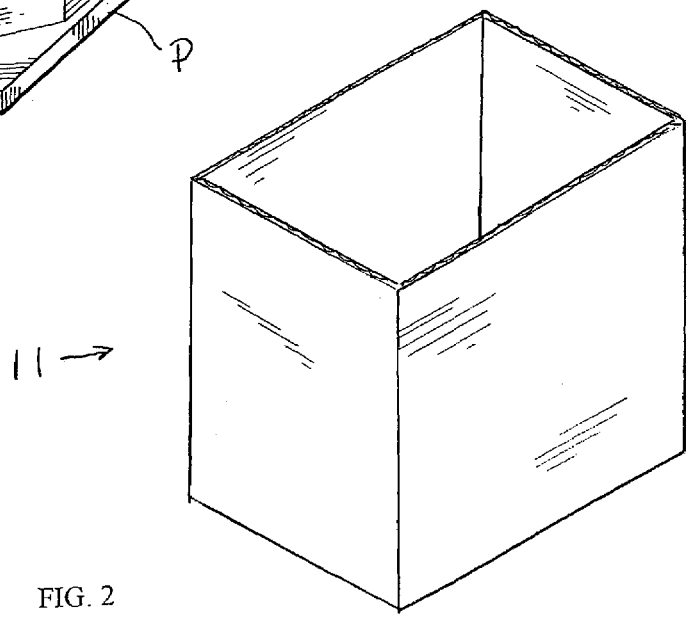
FIG. 2 is a top perspective view of a typical rectangular or square bulk bin in which the invention may be used.

An octagonal bulk container made of corrugated paperboard and incorporating the tear preventing means of the present invention is indicated generally at 10 in FIG. 1, and a rectangular bulk container incorporating the tear preventing means of the invention is indicated generally at 11 in FIG. 2. The invention may also be applied to other container configurations, not shown.

The particular octagonal container 10 depicted in FIG. 1 is of unique construction, and is described more fully in applicant's copending published application, number US 2002 0096559-A1, published Jul. 25, 2002, the disclosure of which is incorporated by reference in full herein. In this container, the diagonal corner panels 12 and 13 have the same width as the end walls 14 and 15, whereby in a container of given volume and adapted to fit a particular size pallet, the side walls 16 and 17 are of reduced width relative to a conventional container in which the diagonal corner panels are narrow and the side walls are wider, with concomitant increased risk of bulging of the side walls when the container is filled with product. The narrower side walls in the container of the invention reduce the risk of bulging of the side walls. It should be understood, however, that the invention is applicable to octagonal containers having other dimensional relationships. The container 10 is shown in FIG. 1 resting on a pallet P, although that does not form a part of the present invention.

"The invention can be best understood with reference to FIGS. 3–11. The blank B from which the container 10 is formed is shown in plan view in FIG. 3, and comprises a series of rectangular panels that form the walls 12–17, and a glue flap 18 on one end. The panels are joined to one another along parallel score lines 20 extending transversely across the blank from a top edge 21 thereof to a flap score 22 at a bottom edge. A plurality of interlocking bottom-forming flaps 23, 24 and 25 are foldably joined to the bottom edge of the blank along the flap score 22, as more fully described in copending published application number US 2002 0096559-A1. The flaps are separated from one another at adjacent edges by cuts or flap slots 26 and 27. In the blank shown, a particular construction of interlocking flaps is employed, with some of the cuts 26 extending parallel to and in alignment with the vertical scores 20, and other cuts 27 extending at an angle to the vertical scores. All the cuts terminate near the end of the respective scores."

Figure 10:
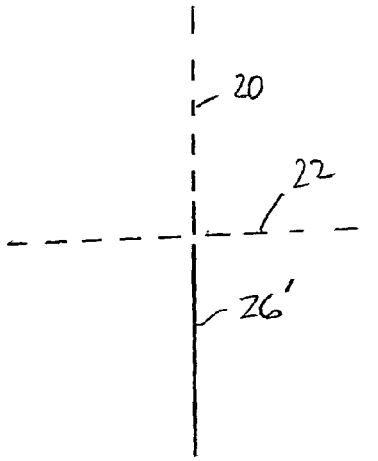
FIG. 10 (PRIOR ART)
FIG. 10 is a fragmentary plan view showing the relevant portion of a blank incorporating anther prior art arrangement, wherein the flap slot or cut simply terminates in a straight line oriented toward and in alignment with the end of the vertical score.

In some conventional constructions, as shown in FIG. 10 for example, the flap slot 26' simply terminates in axially aligned, slightly spaced relationship to the end of the vertical score 20. This construction is especially susceptible to initiation of tearing along the vertical score 20 because of concentration of stresses at the end of the cut, which are directed or focused toward and into the adjacent end of the score.

Figure 6:
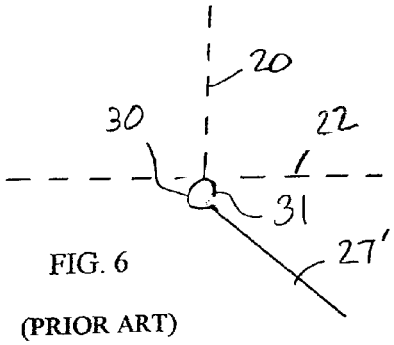
FIG. 6 (PRIOR ART)
FIG. 6 is a fragmentary plan view showing the relevant portion of a blank incorporating a prior art arrangement.

FIG. 6 depicts a prior art arrangement wherein the flap slot 27' extends angularly relative to the vertical score 20, and an upwardly open hook shaped cut 30 is made at the terminal end of the flap slot to at least partially alleviate the shortcomings of the arrangement shown in FIG. 10. However, the cut 30 has a relatively small radius and ends in a vertically directed point 31 that is closely adjacent the vertical score 20. With this arrangement, it is still possible for stress to be concentrated and focused along the axis of the flap slot and into the lower end of the vertical score, with the result that initiation of tearing of the vertical score can occur at this point.

Figure 7:
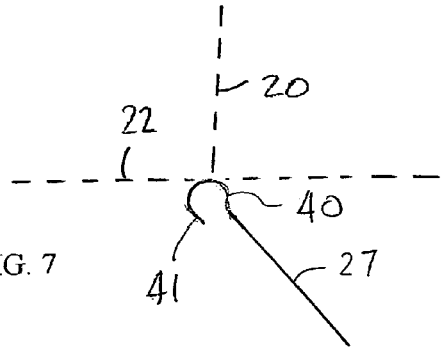
FIG. 7 is a fragmentary plan view similar to FIG. 6, showing another embodiment of the invention intended to replace the prior art arrangement of FIG. 6.

"In the invention, a larger radius, i.e., ⅜ inch, hook shaped cut 40 is made in the material of the flaps at the end of the angled flap slots, as shown in FIG. 7, and inverted from the prior art arrangement so that it opens downwardly, with the terminal end 41 of the hook pointing away from the end of the score and laterally back into the adjoining flap. With the arrangement of the invention, the end of the flap slot 27 is spaced a greater distance from the score 20, and the end 41 of the cut points laterally away from the end of the vertical score so that stress is redirected away from the score and back into the flap, thereby avoiding initiation of tearing of the vertical score at this point."

Figure 8:
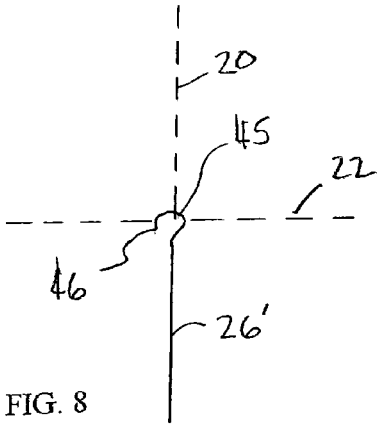
FIG. 8 (PRIOR ART)
FIG. 8 is a fragmentary plan view showing the relevant portion of a blank incorporating anther prior art arrangement.
Figure 9:
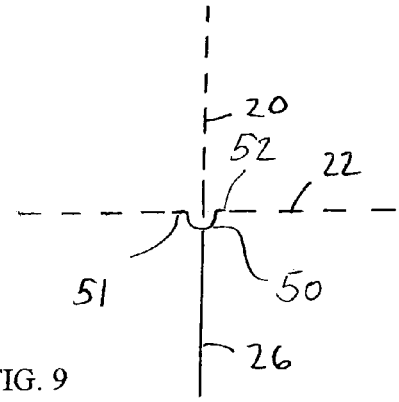
FIG. 9 is a fragmentary plan view similar to FIG. 8, showing an embodiment of the invention intended to replace the prior art arrangement of FIG. 8

In the prior art arrangement shown in FIG. 8, wherein the flap slot 26' extends in alignment with the vertical score 20, a relatively small radius downwardly open hook shaped cut 45 similar to that shown in FIG. 6 is made at the terminal end of the flap slot, with the end 46 of the cut 45 pointing generally vertically, or parallel to the score 20 and flap slot 26'. This construction is not entirely satisfactory for preventing concentration of stress in the lower end of the vertical score and initiation of tearing of the score at this point.

"As shown in FIGS. 3–5 and 9, the invention solves this problem by making a cut 50 resembling a slightly modified Greek letter psi (Ψ) at the end of the flap slot, spaced into the respective flaps and away from the end of the score, with the ends 51 and 52 of the cut 50 extending about ¼ inch laterally outwardly and away from the end of the score to redirect stress away from the end of the *score*. T*his* avoids concentration of stress into the lower end of the score and prevents initiation of tearing of the score at this *point*."

Figure 11:
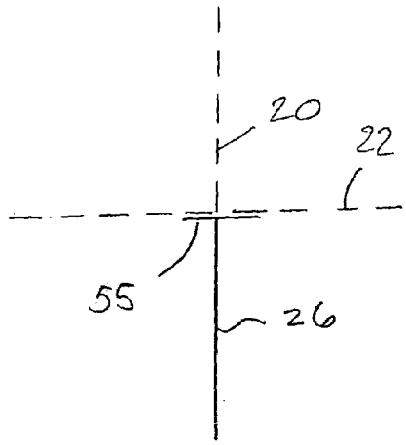
FIG. 11 is a fragmentary plan view similar to FIG. 10, showing a further embodiment wherein the flap slot terminates in a "T" shaped cut that redirects stress away from the adjacent end of the vertical score.

A variation of termination of the flap slot 26 is shown in FIG. 11, wherein a short transverse cut 55 is made across the end of the flap slot, forming a "T" shaped configuration spaced from the adjacent end of the vertical score 20, and which redirects stress laterally away from the vertical score.

Figure 3:
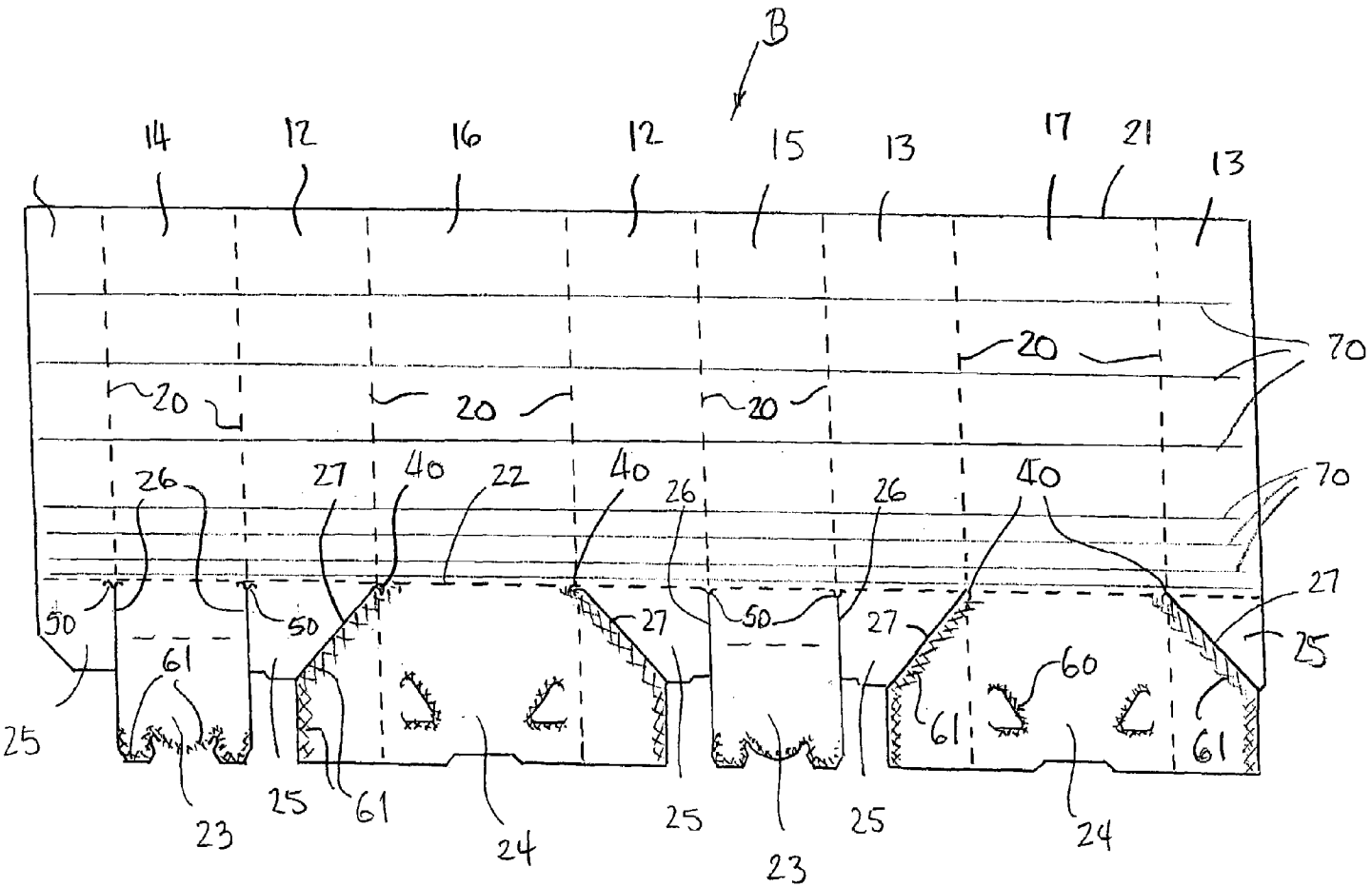
FIG. 3 is a plan view of a blank for making an octagonal bulk bin that has some flap slots extending collinear with the vertical score and other flap slots extending at an angle to the vertical score, and that incorporates those embodiments of the invention for separating the ends of the respective flap slots from the vertical scores.
Figure 4:
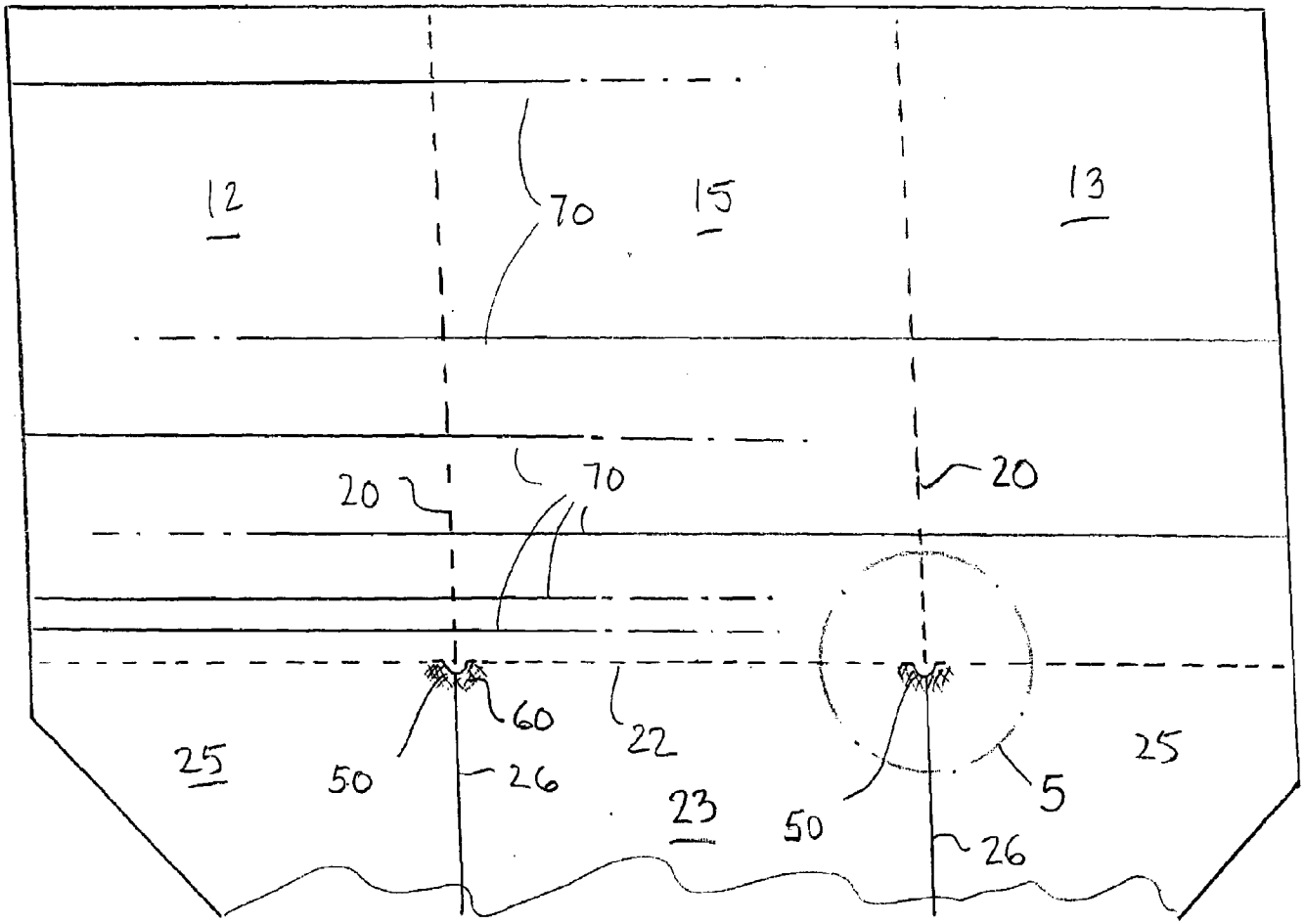
FIG. 4 is an enlarged fragmentary plan view of a portion of the blank of FIG. 3, showing in greater detail one of the embodiments of FIG. 3.
Figure 5:
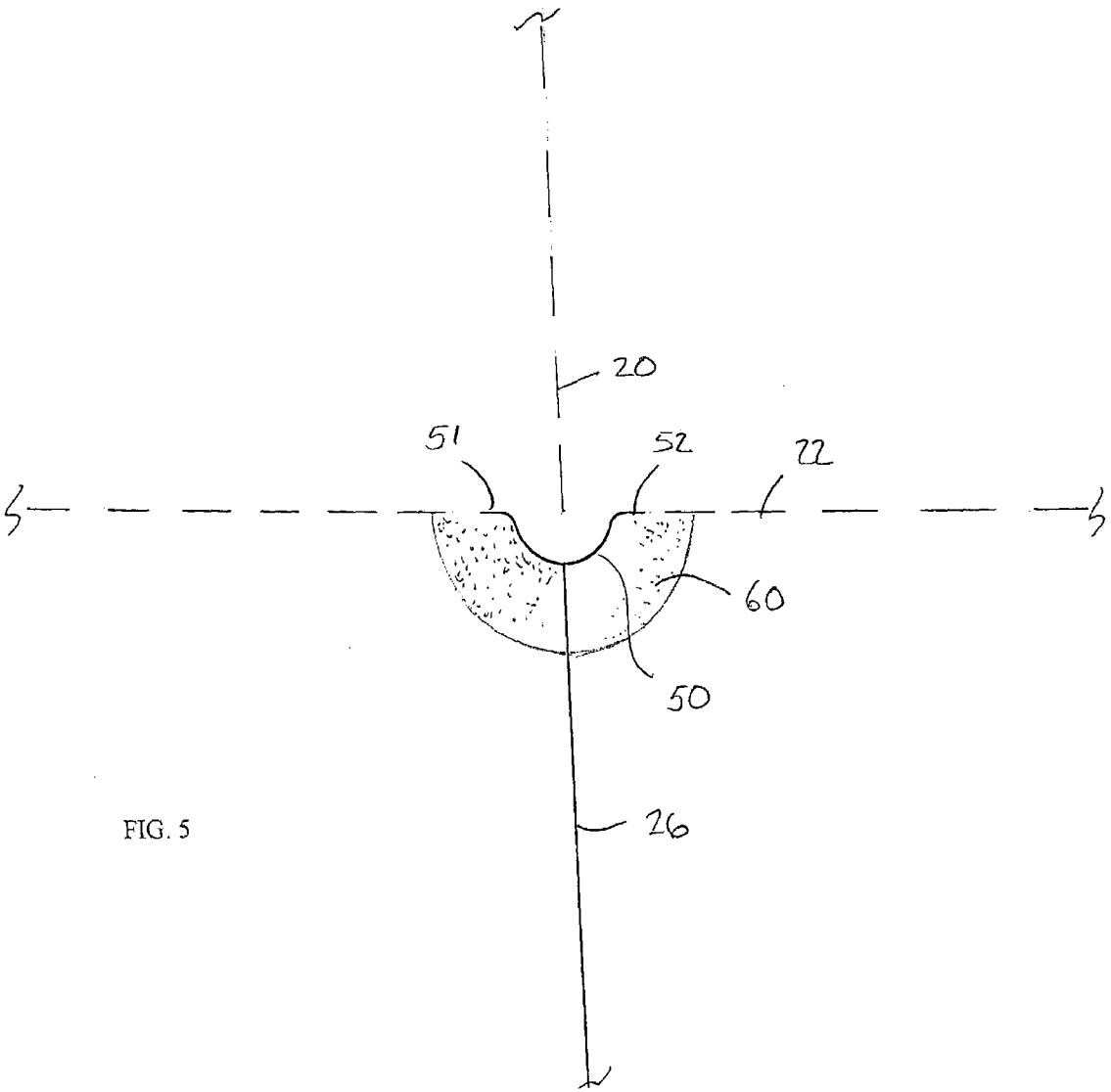
FIG. 5 is an even greater enlarged view, showing the circled portion in FIG. 4.

The corrugated material around the cuts 50 preferably is crushed at 60 to prevent bulking of material when the flaps are folded about their respective fold lines and interlocked with one another. These crushed areas are made on a one inch radius, with the shape as shown in FIG. 5. Crushed areas 61 are also formed along the edges of the flaps, as shown in FIG. 3, to prevent bulking of material in this area.

If desired, additional reinforcing in the form of sesame tape 70 may be applied in the walls of the container at spaced locations along its height.

Although particular embodiments of the invention are illustrated and described in detail herein, it is to be understood that various changes and modifications may be made to the invention without departing from the spirit and intent of the invention as defined by the scope of the appended claims.

What is claimed is:

1. In a bulk container made of corrugated paperboard folded to define side walls joined at adjacent edges along vertical scores, and bottom-forming flaps joined to a bottom edge of the side walls along flap scores perpendicular to the vertical scores, wherein adjacent flaps are separated from one another by flap slots that have a terminal end near but spaced from associated vertical scores, the improvement comprising:

an arcuate stress-relieving cut line made through the material of the flaps between the terminal end of the respective flap slots and the associated vertical scores, each said arcuate cut line having a portion connected with the terminal end of a said flap slot and a portion substantially contiguous with a said flap score, and terminating in an end spaced from and pointed laterally away from a said vertical score, out of alignment with the vertical score, and into the flap material to redirect stresses away from the vertical score and resist initiation of tearing of the vertical score adjacent the terminal end of the flap score, wherein the shaped cut line has a shape substantially like an upside down Greek letter psi, with a central curved portion curved away from the vertical score, and opposite ends pointing laterally outwardly away from the central curved portion.

2. A bulk container as claimed in claim 1, wherein:

a portion of the material adjacent the curved central portion of the shaped cut line is crushed to prevent bulking of the corrugated material when the flaps are folded into their operative position.

3. A bulk container as claimed in claim 2, wherein:

the flap slot extends in alignment with the vertical score, and the opposite ends of the shaped cut line extend generally collinear with the flap score.

4. In a bulk container made of corrugated paperboard folded to define side walls joined at adjacent edges along vertical scores, and bottom-forming flaps joined to a bottom edge of the side walls along flap scores perpendicular to the vertical scores, wherein adjacent flaps are separated from one another by flap slots that have a terminal end near but spaced from associated vertical scores, the improvement comprising:

an arcuate stress-relieving cut line made through the material of the flaps between the terminal end of the respective flap slots and the associated vertical scores, each said arcuate cut line having a portion connected with the terminal end of a said flap slot and a portion substantially contiguous with a said flap score, and terminating in an end spaced from and pointed laterally away from a said vertical score, out of alignment with the vertical score, and into the flap material to redirect stresses away from the vertical score and resist initiation of tearing of the vertical score adjacent the terminal end of the flap score, wherein:

the bulk container is octagonally shaped in transverse cross-section, with opposite side walls, opposite end walls, and diagonal corner panels;

said arcuate stress-relieving cut line comprises a first shaped cut line between the terminal end of a first said flap slot and an adjacent bottom end of a first said associated vertical score between a side wall and an adjacent diagonal corner panel, and a second shaped cut line between the terminal end of a second said flap slot and a second said associated vertical score between an end wall and an adjacent diagonal corner panel, said second shaped cut line having a different shape and orientation than said first shaped cut line; and the second shaped cut line has a shape substantially like an upside down Greek letter psi, with a central curved portion curved away from the vertical score, and opposite ends pointing laterally outwardly away from the central curved portion.

5. A bulk container as claimed in claim 4, wherein:

a portion of the material adjacent the curved central portion of the shaped cut line is crushed to prevent bulking of the corrugated material when the flaps are folded into their operative position.

6. A bulk container as claimed in claim 5, wherein:

the flap slot extends in alignment with the vertical score, and the opposite ends of the shaped cut line extend generally collinear with the flap score.

7. A corrugated paperboard blank for making a bulk container having opposite wall panels foldably joined along vertical scores and bottom flaps foldably joined to the wall panels along flap scores, said blank comprising:

a series of rectangular wall-forming panels connected to each other along said vertical scores and adapted to form said wall panels in a container erected from the blank;

a plurality of bottom-forming flaps foldably joined to one edge of the wall-forming panels along said flap scores and adapted to form said bottom flaps in a container erected from the blank;

said bottom-forming flaps being separated from one another by flap slots extending between adjacent edges thereof, said flap slots having a terminal end spaced from an adjacent end of an associated adjacent vertical score; and arcuate stress-relieving cut lines made through the material of the flaps between the terminal end of the flap slots and adjacent end of an associated vertical score, said shaped cut lines having a portion connected with the terminal end of the flap slot and a portion substantially contiguous with the flap score, and terminating in an end spaced from and pointed laterally away from the vertical score, out of alignment with the vertical score, and into the flap material to redirect stresses away from the vertical score and resist initiation of tearing of the vertical score adjacent the terminal end of the flap score in a bulk container erected from the blank, wherein the shaped cut lines at the terminal end of the first flap slots have a shape substantially like an upside down Greek letter psi, with a central curved portion curved away from the vertical score, and opposite ends pointing laterally outwardly away from the central curved portion generally perpendicular to the vertical score.

8. A blank as claimed in claim 7, wherein:

said flap slots include first flap slots extending parallel to and in general alignment with an associated adjacent vertical score, and second flap slots extending at an acute angle to an associated adjacent vertical score.

9. The blank as claimed in claim 7, wherein:

a portion of the material adjacent the curved central portion of the shaped cut line is crushed to prevent bulking of the corrugated material when the flaps are folded into their operative position.

10. The blank as claimed in claim 9, wherein:

the flap slot extends in alignment with the vertical score, and the opposite ends of the shaped cut line extend generally collinear with the flap score.

* * * * *